United States Patent [19]

Greenlees

[11] 4,199,173

[45] Apr. 22, 1980

[54] CLIPBOARD WITH ELASTIC BAND FOR HOLDING SHEETS

[76] Inventor: James Greenlees, 399 Asharoken Ave., Northport, N.Y. 11768

[21] Appl. No.: 7,466

[22] Filed: Jan. 29, 1979

[51] Int. Cl.[2] ..... B42D 5/00

[52] U.S. Cl. ..... 281/45; 24/255 R; 248/451

[58] Field of Search ..... 24/243 R, 255 R; 211/89; 248/451, 452; 281/45, 46, 47; 402/8, 13

[56] References Cited

U.S. PATENT DOCUMENTS

| | | | |
|---|---|---|---|
| 316,534 | 4/1885 | Frampton | 248/451 |
| 374,386 | 12/1887 | Winne | 248/451 X |
| 704,734 | 7/1902 | Brugerolles | 281/45 |
| 3,650,502 | 3/1972 | Langhi | 211/89 X |

*Primary Examiner*—Paul A. Bell

*Attorney, Agent, or Firm*—Edward H. Loveman

[57] ABSTRACT

A clipboard with improved sheet holding means includes an elastic band stretched across a flat, rigid board and having opposite ends secured near opposite corners of the board. On the band are spaced solid beads having bores through which the band extends. The beads may be adjustably positioned along the band or their positions may be fixed. Underneath each of the beads is a friction pad or friction surface. A single sheet of a pile of sheet material may be held between the beads and the friction pads. The beads may be shaped and the bores are located so that the beads and band cam upwardly when a sheet is being pulled away from the pile under the elastic band. The beads can be a cubical with rounded edges, ellipsoidal with bores extending across the shorter diameters, or spherical with bores eccentrically located.

10 Claims, 11 Drawing Figures

CLIPBOARD WITH ELASTIC BAND FOR HOLDING SHEETS

This invention concerns a clipboard having elastic means for holding a paper sheet or sheets thereon.

Heretofore clipboards have employed metal spring biased clamps to retain thin paper sheets thereon. This type of construction has a number of disadvantages. In order to remove the sheets it is necessary to retract the spring clamp of clip with one hand while removing a sheet with the other hand. The spring clamp holds the sheet on the clipboard only at the center of the sheet, which leaves the upper edges of the sheets free to curl upwardly. The use of metal clips becomes a matter of considerable expense when the clipboards are produced by mass production methods. In addition, this type of clipboard is difficult or even sometimes impossible to operate by many people including the handicapped.

The present invention provides improved sheet holding means for a clipboard which avoids the disadvantages of the prior clipboard sheet holders and allows the clipboard to be used with only one hand or by a preschool age child or a manually weak individual. According to the invention an elastic band is stretched in tension across a flat board or plate near one edge thereof. The band is secured at opposite ends by eyelets or rivets located at the corners of the board. On the band is a plurality of beads spaced apart along the band. The beads may be cubical with rounded corners, spherical, ellipsoidal, or of other geometric shape with rounded edges. The band extends through holes bored in the beads and when the beads are cubically shaped, they are cammed upwardly when a sheet is pulled off the board. Underneath the beads is a friction pad which cooperates with the beads and band in holding sheets on the clipboard. Since the elastic band is expansible, a pile of sheets of different thicknesses may be held on the board. The beads may have roughened, friction surfaces. Spherical beads may be eccentrically bored in order to obtain a desired camming effect. Beads may be in set spaced positions along the band or may be adjustably positioned along the band. By the arrangement described sheets may be removed simply by pulling them off the board with one hand. Use of expensive metal parts is avoided, and the clipboard sheet holding means can be manufactured economically and at lower cost than prior sheet holders.

These and other objects and many of the attendant advantages of this invention will be readily appreciated as the same becomes better understood by reference to the following detailed description when considered in connection with the accompanying drawings in which:

FIG. 1 is an oblique plan view of a clipboard embodying one form of the invention;

FIG. 2, FIG. 3, and FIG. 4 are enlarged fragmentary sectional views taken along lines 2—2, 3—3, and 4—4 of FIG. 1;

Figure 3:
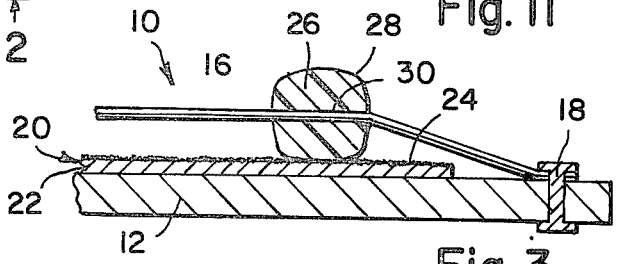
Figure 2:
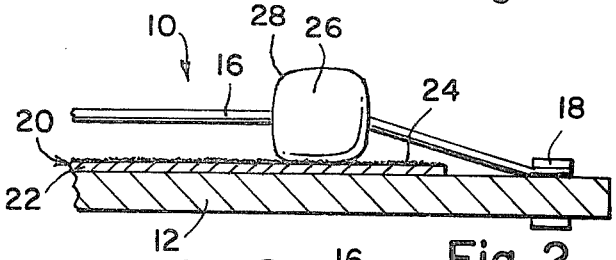

Referring now to the drawings, wherein like reference characters designate like or corresponding parts throughout, there is illustrated in FIGS. 1-4, a clipboard assembly generally designated as reference numeral 10 including a flat, rigid rectangular board 12 made of metal, plastic, fibreboard, or other suitable material. Near on top edge 14 is mounted an elastic band 16. Opposite ends of the band 16 are secured to rivets 18 or other suitable fastening means licated near the opposite corners of the board top edge 14. On the elastic band 16 which may be an extension spring, or made of rubber or fabric covered rubber, is a plurality of solid beads 26. On the board 12 is secured a friction pad 20 made of a paper 22 covered with a sand grit 24. Although the friction pad 20 is illustrated, as extending under a large portion of the band 16, it is obvious that the friction pad 20 may be comprised of a plurality of pads, one situated under each of the beads 26. The beads 26 are rigid and may be cubical in form with rounded edges 28 and may be made of molded plastic or composition material. A bore 30 extends centrally through each bead strung as formed on the band 16. The beads 16 are tightly held in place, on the band 16, since the diameter of the bore 30 is equal to or slightly less than the free diameter of the band 16. Inside the bore 30, the band 16 is compressed. The beads 26 may be adjustably spaced by pulling them along the band 16, and will remain in the place set by the compression of the band 16 in the bore 30. The friction surface 24 of pad 20 faces upwardly toward the band 16, and the beads 26 rest on the pad 20 as shown in FIGS. 2 and 3, since band 16 is stretched in tension between the fasteners 18. A pile 34 of paper sheets 31, 32, 33 is shown mounted on the clipboard 10 in FIG. 4. The pile 34 is indicated by dotted lines in FIG. 1. One marginal portion of the sheets is engaged between the friction pad 20 and the beads 26. If the upper sheet 31 is pulled toward a bottom edge 36 of the board 12, the beads 26 will cam upwardly on their edges to increase the tension in the band 16. Then as the sheet 31 is pulled free, the beads 26 will assume their former stable position shown in FIGS. 2 and 3, to hold remaining sheet or sheets 32, 33, in place. The beads 26 rotate with the band 16 which serves to further increase tension in the band 16 and to increase the pressure of the beads 26 on the pile of sheets on the clipboard 10. It should also be understood that the sheet 31 may be pulled toward the upper edge 14 of the board 12 and the beads 26 and band 16 will operate as described above.

Figure 5:
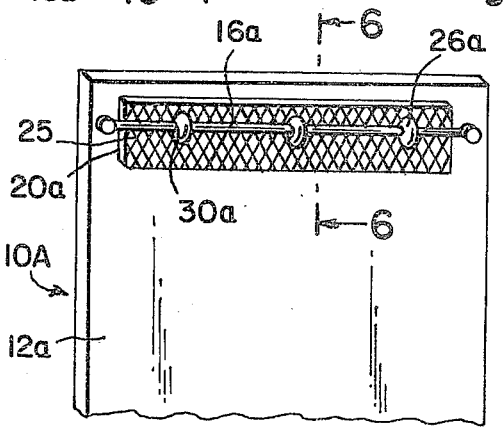
FIG. 5 is an oblique plan view of part of another clipboard embodying another form of the invention.
Figure 6:
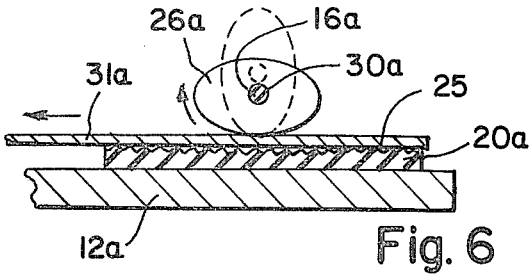
FIG. 6 is an enlarged fragmentary sectional view taken along line 6—6 of FIG. 5.

FIGS. 5 and 6 show another clipboard assembly 10A which the friction pad 20*a* is made of flexible rubber or plastic material with a ribbed, corrugated or roughened surface 25. Beads 26*a* are ellipsoidal in form and each has a bore 30*a* extending across the shorter central diameter of each bead 26*a*. The band 16*a* is compressed in the bores 30*a* to hold the beads 26*a* in place on the stretched band 16*a*. The beads 26*a* cam upwardly to the dotted line position shown in FIG. 6 when a sheet 31*a* is pulled in the plane of the board 12*a*.

Figure 8:
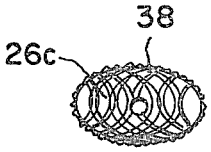
FIG. 7 and FIG. 8 are side views of ellipsoidal beads which can be used on the clipboard.
Figure 7:
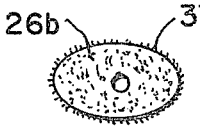

In FIGS. 7 and 8 are shown other ellipsoidal beads. A bead 26*b* (FIG. 7) has a grit surface 37 and a bead 26*c* (FIG. 8) has a corrugated or ribbed surface 38. These friction surfaces are intended to provide a firmer engagement between the beads and the upper surface of the topmost sheet 31*a* on the clipboard 10. These friction surfaces will assist camming rotation of the beads 26 when the sheet is pulled off the clipboard 10. A plurality of each type of bead **26*b* or 26*c* could replace the beads 26 or 26*a* on the clipboard 12 or 12*a***.

Figure 9:
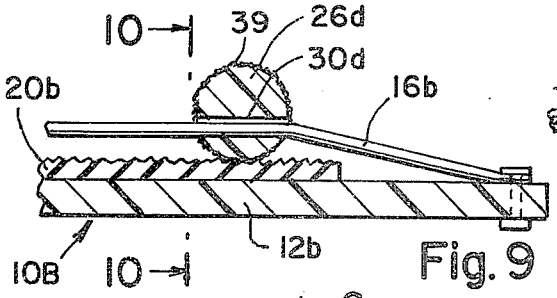
FIG. 9 is an enlarged fragmentary sectional view similar to FIG. 3 of a further clipboard embodying a further form of the invention.
Figure 4:
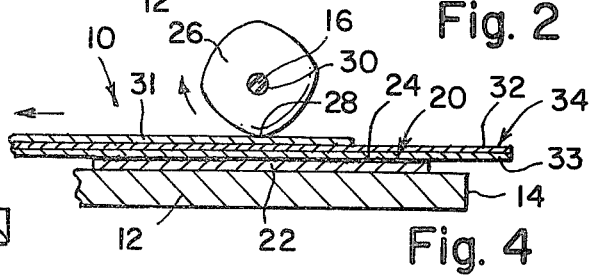
Figure 10:
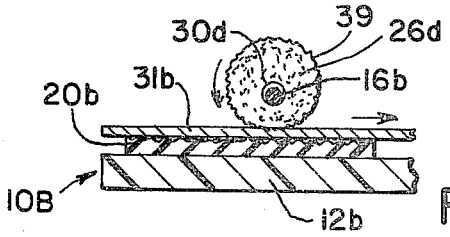
FIG. 10 is an enlarged fragmentary sectional view taken along line 10—10 of FIG. 9.

In FIGS. 9 and 10 is shown another clipboard assembly 10B in which spherical beads **26*d*, of which only one is shown, are mounted on a stretched band 16*b*. The diameter of a bore 30*d* is larger than that of the band 16*b* so that the beads can rotate on the band 16*b* as indicated in FIG. 10. The beads 16*b* have friction grit outer surfaces 39. It will be noted that the bore 30*d* of each bead 26*d* is eccentrically located so that it is normally closer to board 12*b* than to the upper side of the bead 21*d*. When a sheet 31*b*, on the clipboard 10*b* between the beads 26*d* and the friction pad 20*d*, is pulled toward the top or bottom edge of the clipboard 10*b*, the beads 26*b* will cam upwardly due to the eccentric positioning of the bores 30*d***.

Figure 1:
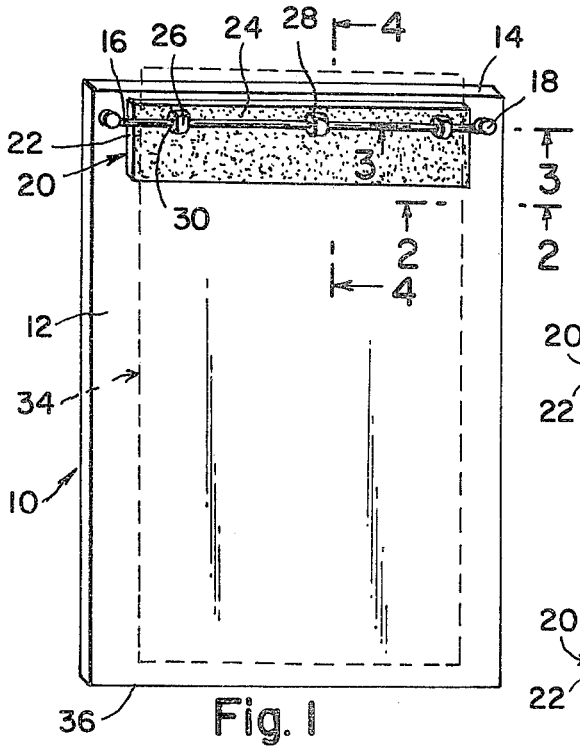
Figure 11:
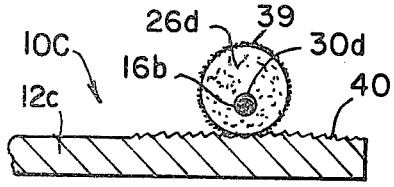
FIG. 11 is a sectional view similar to FIG. 10 of still another clipboard.

FIG. 11 shows a further clipboard assembly 10C in which a rigid board **12*c* has an intergral portion formed with a serrated or knurled friction surface 40 so that an attached friction pad can be dispensed with. Other parts of the assembly correspond to those of assembly 10B. It will be understood that friction surface 40 can be used under the band 16 or 16*a* of assemblies 10A and 10B to replace pads 20 and 20*a***.

It will be apparent from the foregoing description that the clipboards 10, 10A, and 10B can be equipped with the elastic bands 16 and beads 26 in a very easily assembled economical fashion. The clipboard assemblies can be manufactured by mass production machinery at comparitively low cost. They have the disirable feature of beads being adjustably spaced along the elastic bands to hold sheets of different widths or even narrow strips anywhere along the band. In prior clipboards, narrow paper strips could only be held centered under the spring biased metal clips.

It should be understood that the foregoing relates to only a limited number of preferred embodiments of the invention which are considered the best modes of practicing the invention but which have been by way of example only, and that it is intended to cover all changes and modifications of the examples of the invention herein chosen for the purposes of the disclosure, which do not constitute departures from the spirit and scope of the invention.

What is claimed:

1. A clipboard assembly for holding a sheet material comprising:

a flat, rigid board;

an elastic band stretched across said board;

means securing opposite ends of said band to said board;

friction means on said board under said band and having an upper friction surface facing said band; and a plurality of beads mounted on said band, said beads having bores extending through said beads, said band extending through said bore, so that said beads are adjustably positioned along said band.

2. A clipboard assembly as defined in claim 1, wherein said friction means is a pad formed of flexible material of uniform composition throughout.

3. A clipboard assembly as defined in claim 1, wherein said friction surface is integral with said board.

4. A clipboard assembly as defined in claim 1, wherein each of said beads is shaped so as to rotate with a camming motion of said beads when an upper one of said sheet material is pulled off said board from underneath said band.

5. A clipboard assembly as defined in claim 4, wherein each of said beads is cubical in form with rounded edges.

6. A clipboard assembly as defined in claim 4, wherein each of said beads is ellipsoidal in form, said bores extending through shorter diameters of said beads.

7. A clipboard assembly as defined in claim 4, wherein each of said beads is spherical, and said bores are eccentrically located in said beads.

8. A clipboard assembly as defined in claim 4, wherein each of said beads has an outer friction surface to facilitate rotation of said beads when said upper sheet material is pulled away from said board.

9. A clipboard assembly as defined in claim 4, wherein the diameter of said band is smaller than the diameter of said bores to facilitate turning and camming said beads on said band.

10. A clipboard assembly as defined in claim 4, wherein the diameter of said band is larger than that of said bores so that said band is compressed in said bores to hold said beads in set positions spaced along said band.

* * * * *